US005372309A

United States Patent [19]

Ehle et al.

[11] Patent Number: 5,372,309

[45] Date of Patent: Dec. 13, 1994

[54] AIRLESS NOZZLE USING AMBIENT AIR FOR IMPROVED ATOMIZATION

[76] Inventors: Larry L. Ehle, 1115 Northwood Dr., Anderson, Ind. 46011-1026; Alfred E. Behrens, 2103 Sheffield Ave., Anderson, Ind. 46011

[21] Appl. No.: 151,904

[22] Filed: Nov. 15, 1993

[51] Int. Cl.[5] ..... B05B 7/08; B05B 1/28

[52] U.S. Cl. ..... 239/288.5; 239/290; 239/296; 239/299; 239/428.5; 239/597; 239/599

[58] Field of Search ..... 239/288.5, 290, 428.5, 239/429, 596, 597, 599, 105, 296, 299

[56] References Cited

U.S. PATENT DOCUMENTS 2,743,138 4/1956 Wahlin ..... 239/597
3,774,847 11/1973 Malec ..... 239/429 X
4,349,153 9/1982 Johnson ..... 239/428.5 X
4,349,947 9/1982 Rood ..... 239/599 X
4,645,127 2/1987 Emory et al. ..... 239/599 X
4,842,203 6/1989 Kuhn et al. ..... 239/299 X

*Primary Examiner*—William Grant
*Attorney, Agent, or Firm*—Robert A. Spray

[57] ABSTRACT

An improvement in reduction of particle size of painting and coating particles is achieved by providing a tapered channel(s) in the cylindrical wall radially of the spray apparatus' nozzle head, which is a wall adjacent the nozzle outlet slit. Using the "Bernoulli Principle," its venturi feature achieves a movement and acceleration of ambient air to intermix with the paint particles being dispensed through the nozzle outlet slit. The tapered channel(s) extends radially inwardly from an air inlet opening on the exterior face of the wall, fully through the wall, and into a downstream air outlet opening on the interior of the wall face, the tapering of the channel being of a downstream size-reducing nature.

21 Claims, 2 Drawing Sheets

AIRLESS NOZZLE USING AMBIENT AIR FOR IMPROVED ATOMIZATION

FIELD OF THE INVENTION

The present invention relates to airless liquid spray apparatus, as for "spray" procedures for applying paint or other coating; and more particularly the invention relates to concepts for bettering the "atomized" spray delivery of the coating achieved by use of the apparatus.

The "atomized" particle size of the spray of this type apparatus is of course not asserted to actually be as small as that of atoms, or even in the range of molecules, yet the conventional descriptive term "atomized" is commonly used as indicative of very small and discrete particles which are dispensed for use in the form of a fine mist; and it is this small particle size, already a very small particle size, as compared to which the present invention achieves a desired size-reduction for improved spray-painting characteristics.

THE PARTICULAR PROBLEM WHICH MANY YEARS OF PRIOR ART HAVE NOT SOLVED

The specific problem whose improvement is achieved by the concepts of the present invention is that of particle size.

As mentioned, the particle size has already been achieved by the prior art to be very minute, so minute as to be referred to as of "atomized" size; yet the reduction of particle size, as achieved by the present invention, provides such a significantly smaller particle size that a significant improvement in the surface appearance of the painted coating is achieved.

The smaller particle size's benefits are perhaps most often apparent in the edge portion of coating strokes, but even inner portions of a coating area coated by prior art apparatus show themselves to be objectionally less than perfect, which reduces the value and desirability of the coated object to discriminating purchasers.

After all, although paint and other coatings are applied partly for reasons of protection and the retardation of corrosion and/or detriments of life and use of the coated article, a very significant reason for painting or the application of other coatings is for the purpose of surface attractiveness, and thus attractiveness of the article itself as an object.

And attractiveness of the surface finish is achieved by the evenness and smoothness of the coating.

The evenness and smoothness of the coating has long been known to have been improved by "atomized" smallness of particle size; and thus the reduction of particle size is the very worthy object of the improvement of the painting procedures, a particle size reduced to a size even smaller than "atomized".

SUMMARY OF THE INVENTION AND ITS CONCEPTS

Providing an advantageous improvement as to reduction of particle size of painting and coating particles, the present invention provides an advantageous and novel combination of apparatus features by which the particle size is advantageously reduced.

More particularly, the present invention and its concepts provide a tapered channel in the cylindrical wall of a nozzle head, the channel axis of which channel is adjacent and spaced downstream from the nozzle outlet slit of prior art apparatus at the air outlet of the channel, achieving a movement and acceleration of ambient air to intermix with particles being dispensed through the nozzle outlet slit.

The tapered channel extends radially inwardly from an air inlet opening on the exterior face of the wall, fully through the wall, and into an air outlet opening on the interior of the wall face, the tapering of the channel being of a downstream size-reducing nature.

Preferably there are at least two such tapered channels, disposed diametrically opposite one another in the wall adjacent the nozzle slit of prior art apparatus; and two embodiments are shown for illustration of the concepts, one having flat but tapering walls, and the other having a tapered channel achieved by the provision of a conical channel surface in the wall.

Other details and features are shown in the drawings and described in the text.

PRIOR ART CAPABILITY, DEVICES AND PROCEDURES, AS HELPING TO SHOW THE INVENTIVE NATURE AND PATENTABILITY OF THE PRESENT CONCEPTS AS COMBINATIONS:

Even to look by hindsight, for consideration of the concepts of the present invention to determine the combination's inventive and novel nature in the combination of its concepts, it is not only conceded but emphasized that the prior art has had many details of apparatus and procedures, which could have been usable in achieving the advantages of the present invention, but only if the prior art had had the guidance of the present concepts, and particularly their concepts in cooperative combination.

That is, it is emphasized that the prior art had/or knew several particulars which individually and accumulatively show the non-obviousness of this combination invention. E.g., as to prior art particulars and motivations:

(a) The prior art has had for many decades the aggravating problem of unevenness or lack of sufficient smoothness of the surface of paint or other coatings;

(b) The prior art has long known of the annoying and often quite bothersome problem of the factor of largeness of particle size as causing surface unevenness, over visible paint areas, particularly along overlapping edges, causing unevenness of surface by lack of blend of the outer surface portions;

(c) The prior art has long known of the expense of re-work of attempting to cure unsightly surface unevenness, especially at a juncture of edges, and even extra costly re-work when the re-work causes new edge-portions, or some areas new unevenness of coating;

(d) Substantially all of the operational characteristics and advantages of details of the present invention, when considered separately from one another and when considered separately from the present invention's apparatus and accomplishments in their respective combinations, are within the skill of persons of various arts, but only when considered away from the integrated and novel combination of concepts which by their cooperative combinations achieve this advantageous invention, considered as to its overall apparatus operativity;

(e) The details of the present invention, when considered solely from the standpoint of construction, are exceedingly simple; and the matter of simplicity of construction has long been recognized as indicative of inventive creativity; and (f) Similarly, and a long-recognized indication of inventiveness of a novel combination, is the realistic principle that a person of ordinary skill in the art, as illustrated with respect to the claimed combinations as differing in the stated respects from the prior art both as to construction and concept, is that the person of ordinary skill in the art is .presumed to be one who thinks along the line of conventional wisdom in the art and is not one who undertakes to innovate;

(g) Particular prior art known to the inventors, which may approach the construction and/or productivity and/or results of the present invention, are as follows. All of the following are believed to be owned by Nordson Company, as follows, all U.S. Pat. Nos.:

3,658,257 Apr. 25, 1972
3,737,108 Jun. 5, 1973
3,843,055 Oct. 22, 1974
4,337,281 Jun. 29, 1982
4,346,849 Aug. 31, 1982
4,349,947 Sep. 21, 1982
4,579,286 Apr. 1, 1986

Accordingly, although the prior art has had capability and motivation, amply sufficient to presumably give incentive to the development or creativity of apparatus according to the present invention, the fact remains the present invention has awaited the present creativity and inventive discovery of the present invention. In spite of ample motivation and capability shown by the many illustrations herein, the prior art did not suggest this invention nor its concepts in their combinations.

SUMMARY OF THE PRIOR ART'S LACK OF SUGGESTIONS OF THE CONCEPTS OF THE INVENTION'S COMBINATION

In spite of all such factors of the prior art, the problem here solved awaited this invention's creativity. More particularly, as to the novelty here of the invention as considered as a whole, considering the prior art helps show its contrast to the present concepts, and emphasizes the advantages and the inventive significance of the present concepts as are here shown, particularly as to labor-saving, convenience-providing, probable low need of maintenance procedures, and particularly surface smoothness and evenness.

Moreover, prior art devices known to these inventors which could possibly be adapted for this duty fail to show or suggest the details of the present concepts as a combination.

And the existence of such prior art knowledge and related articles embodying such various features is not only conceded, it is emphasized; for as to the novelty here of the combination, of the invention as considered as a whole, a contrast to the prior art helps also to show both the great variety of the various prior art and its diversification as to liquid-spraying equipment and apparatus for various uses, and venturi-principle atomizer devices, etc., and the multitude of such diverse and long-known prior art emphasizes the advantages and the inventive significance of the present concepts. Thus, as shown herein as a contrast to all the prior art, the inventive significance of the present concepts as a combination is emphasized, and the nature of the concepts and their results can perhaps be easier understood.

In attempting a hindsight evaluation of the concepts, and particularly of their creativity, it may be a significant thought that the improvement and change in operativity and resulting coating is not only significant but surprising, for one or more possible reasons: (a) The possible reason that the admixture of ambient air with the stream of paint particles, which stream downstream of the nozzle orifice slit, more aptly describable as a sheet, is done significantly downstream of the outlet nozzle and its outlet slit, and/or (b) The possible reason that the tapering channel is fully exposed throughout its entire length to the unlimited and unrestricted presence of an effectively infinite amount of ambient air, with no downstream covering which might be expected to be needed to confine the tapered channel so as to make its successive portions to be of a definitely decreasing cross-sectional area.

Accordingly, the various concepts and components are conceded and emphasized to have been widely known in the prior art as to various devices; nevertheless, the prior art not having had the particular combination of concepts and details as here presented and shown in novel combination different from the prior art and its suggestions, even only a fair amount of realistic humility, to avoid consideration of this invention improperly by hindsight, requires the concepts and achievements here to be realistically viewed as novel combinations, inventive in nature. And especially is this a realistic consideration when viewed from the position of a person of ordinary skill in this art at the time of this invention, and without trying to reconstruct this invention from the prior art without use of hindsight toward particulars not suggested by the prior art.

BRIEF DESCRIPTION OF THE DRAWINGS

The above description of the novel and advantageous invention is of somewhat introductory and generalized form. More particular details, concepts, and features are set forth in the following and more detailed description of illustrative embodiments, reference being had to the accompanying generally diagrammatic and schematic drawings, illustrating concepts, construction, and operational details; and somewhat schematically for emphasis on the concepts and relationships, and ease and convenience of understanding, the views respectively show the following:

FIG. 5 also shows the Sectional view as would be taken by Sec. line 5—5 of FIG. 6 if positioned on the paperr as projected from FIG. 6.

DETAILED DESCRIPTION OF THE ILLUSTRATIVE EMBODIMENTS

Figure 1:
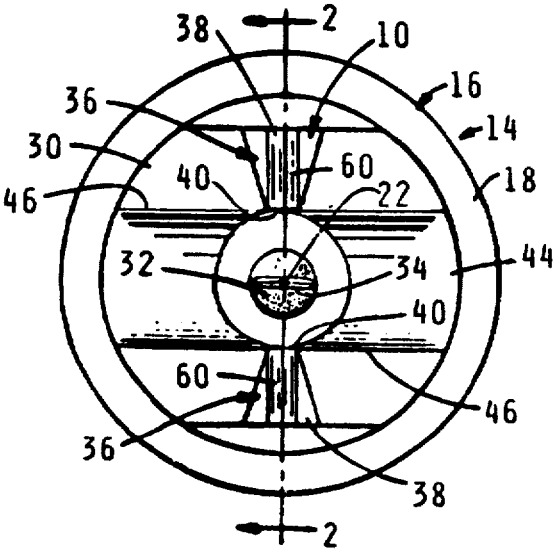
FIG. 1 (and FIGS. 2 and 3 as shown in orthographic projection) is a face-on elevational view of a nozzle head of prior art conventional design, shown as provided with the invention in a 1st Embodiment.

As shown in the drawings, nozzle adaptation means 10 (1st Embodiment) and 12 (2nd Embodiment) are provided for a dispensing head 14 used for and with high pressure liquid atomizer apparatus, typically airless paint spray apparatus which is provided with a dispenser head 14 and an associated source of the liquid under pressure.

The apparatus head 14, here modified by the present invention, is an "atomizer" type dispensing head 14 quite conventional in size, shape, and other characteristics; and the modifications by the present invention's concepts are used and are here shown with a dispensing head 14 of prior art nature.

The external and most apparent body component of the dispenser head 14 is a body member 16 in the form of a small casing, having body means shown as a rigid flange 18, providing for supportive connection to whatever (not shown) is the associated support and guidance means for the apparatus in its atomized spraying use.

The body member 16, quite conventionally, has an upstream inlet 20, a downstream outlet 22, and a passageway which is the internal conduit between and operatively communicating the inlet 20 and the outlet 22, that passageway not shown, however, except as is shown as outlet 22.

Conventionally, the outlet 22 provides and serves as a dispensing nozzle 22 for the "atomized spray" discharge of the liquid under pressure; and the outlet nozzle 22, the inlet 20, and the internal body part which provides their interconnecting passageway, are all provided as a hardened body member addition to the metal body member 16, reducing wear as would be caused by particles of the paint liquid as they exert a scraping action in their high pressure flow.

Also a conventional or prior art feature of the body member 16 is that it has a generally cylindrical wall means 30, to be noted as extending both upstream and serving as a protective nose for the recessed nozzle, also extending downstream of the nozzle 22; and the prior art also provides that the outlet nozzle 22, co-axial with the outlet and passageway 22, has a small convex head 32, and also has, as its most-downstream dispensing outlet opening, a narrow slit 34 in the convex head 32, it being located generally centrally of the wall means 30.

It is in cooperation with that type of conventional or prior art type of apparatus that the present invention's nozzle adaptation means is provided, comprising basically the provision of a tapered channel or channels 36 in the wall means 30, and its effect of drawing in and accelerating inwardly portions of the ambient air surrounding the nozzle head, thus achieving a significant reduction in particle size, with better coating effects and control by minimizing the splattering which seems common in airless paint systems.

As shown (in both Embodiments unless mentioned otherwise), the tapered channel feature 36 has the following characteristics now noted, which are in combination with one another and with features of the apparatus' body member 16 and its own features. (The tapered channel is designated by numeral 36 in the 1st Embodiment, and 36*x* in the 2nd Embodiment.)

As a feature of the tapered channel 36, it extends in a generally radial direction with respect to the wall means 30.

Also as shown the tapered channel 36 extends from an air inlet opening 38 on the exterior of the body 16's wall means 30, fully through the wall means to an air outlet opening 40 on the interior of wall means 30.

It is also to be noted that tapered channel 36's air outlet opening 40 is spaced downstream from although operatively adjacent the nozzle 22 for cooperating with, and taking advantage of the hydraulic effect of, the pressurized flow of liquid through the body member 16 and its nozzle 22, and the consequent venturi effect of the lowering of pressure downstream of the nozzle 22.

Figure 2:
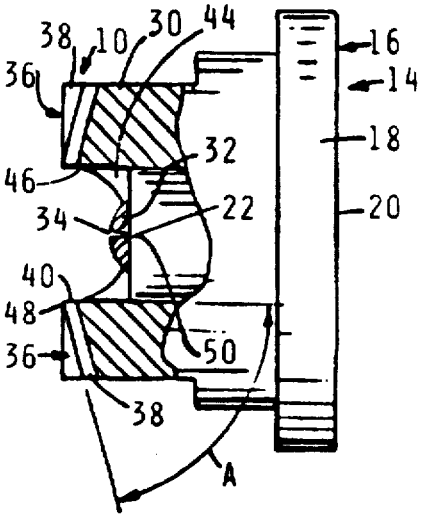
FIG. 2 is a side elevation view of the nozzle head shown in FIG. 1, with portions broken away (per Section line 2—2 of FIG. 1) to show interior details otherwise hidden, and FIG. 2 also shows the Sectional view as would be taken in Sec. line 2—2 of FIG. 3 if positioned on the paper as projected from FIG. 3.
Figure 3:
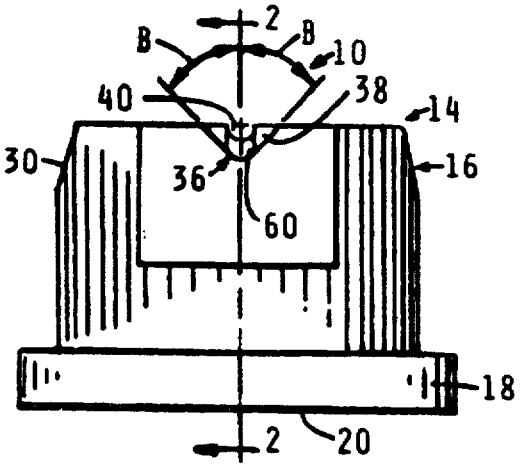
FIG. 3 is a front elevational view of the nozzle head shown in FIG. 1.

As shown, the taper of the tapered channel 36 is of such nature that it is larger at its exterior opening 38 than at its interior opening 40; and the direction of the tapered channel 36, from its exterior opening 38 to its interior opening 40 downstream of the nozzle outlet 22, is downstream of the flow of liquid through the body member 16 and its outlet nozzle 22. More particularly as illustrated in FIGS. 2 and 3, respectively, the taper, from larger size to smaller size, is shown as desirably provided as to both in the direction axially-extending downstream from the nozzle outlet and the direction transversely-extending radially inwardly toward the axis of the nozzle.

As to these provisions of each tapered channel 36 as so far to be noted, they are (a) its radial direction, (b) its downstream direction, (c) its downstream and radially-inwardly size-reducing tapering nature, and (d) its outlet location downstream and its operative adjacency to the body member 16's nozzle outlet 22.

These basic features provide basic operativity of cooperating to draw ambient air through the tapered channel 36 and in a direction operatively near the center of particles of the liquid being dispensed by the body member's nozzle 22, causing the ambient air flowing through the tapered channel 36 to intermix with liquid particles being dispensed, and at operatively high enough velocity, that the liquid of the particle being dispensed is caused to take the form of droplets reduced in size.

Figure 4:
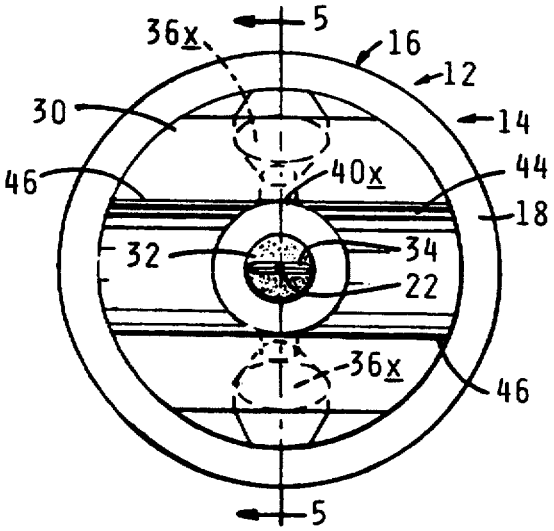
FIG. 4 (and FIGS. 5 and 6 as shown in orthographic projection) is a face-on elevational view of a nozzle head of prior art conventional design, shown as provided with the invention in a 2nd Embodiment.

Desirably as shown the adaptation means invention provides a plurality of the tapered channels 36 spaced circumferentially of the axis of the body member, and particularly diametrically opposite in the form shown; and the direction of the tapered channels 36, considered transversely of the axis of the body member 16, is about 90° from the slit 34 (noting FIG. 1 for tapered channels 36, and FIG. 4 for tapered channels 36*x*).

Another detail or feature of prior art dispenser heads 14, or more particularly of their body members 16, is the provision of a generally semi-cylindrical concave recess 44, this recess 44 being a prior art provision of a slot or groove upstream of this invention's tapered channel 36, the prior art recess 44 providing diametrically-opposed semi-cylindrical openings in the wall 30, immediately at the nozzle outlet 22, for the purpose of providing nozzle orifice protecting extensions and also allowing air flow to the base of the spray stream. which opens in the downstream direction of liquid flow (left as shown), and is at least substantially parallel to the slit 34; and the air outlet (inner) opening 40 of each of the tapered channels 36 is provided to be adjacent the downstream end 46 of the recess 44.

Another feature of the nozzle adaptation means invention as shown is that the inner end of the tapered air channel 36 is radially spaced, from the slit 34 and thus from the sheet-like misty liquid stream being dispensed by the slit 34, about the same distance that the downstream portion 48 of the inner outlet end 40 of the tapered channel 36 is downstream of the upstream edge 50 of the slit 34.

Figure 5:
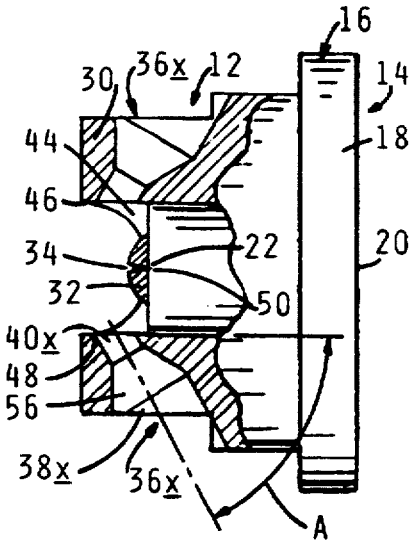
FIG. 5 is a side elevation view of the nozzle head shown in FIG. 4, with portions broken away (per Section line 5—5 of FIG. 4) to show interior details otherwise hidden.
Figure 6:
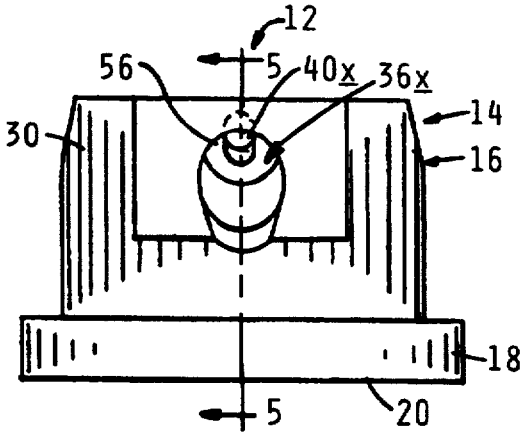
FIG. 6 is a front elevational view of the nozzle head shown in FIG. 4.

More particularly as to the tapered channels 36, they are provided to have their direction downstream of the flow of liquid through the body member 16 and its nozzle 22 ("A") to be about 75° with relation to the flow of liquid. This is with the axis of channel 36 in the 1st Embodiment; as to the 2nd Embodiment, it is about 60° as to the channel 36x axis. Those are the relationships "A" shown in FIGS. 2 and 5. The range of channel axis direction "A" about 60° to about 75°, with relation to the flow of liquid out the outlet 22, seems desirable.

In the 1st Embodiment, the tapered channels 36 are of flat but tapered wall shape; but in the 2nd Embodiment, each tapered channel 36x is provided to have an intermediate portion 56 formed as having a generally conical shape whose size decreases in a downstream and radially inwardly direction, the narrowest portion of the generally conical shape being adjacent the interior downstream opening 40 of the tapered channel 36x.

The "taper ratio," i.e. the extent or rapidity of taper, (the ratio of the cross-sectional area of the tapered channel's inlet to outlet) may be significant; and thus it is to be noted that that ratio in the 1st Embodiment is about 3.7 to 1, while the ratio in the 2nd Embodiment is about 6.2 to 1, as measured cross-sectionally to the respective axis. (Inlet and outlet are identified as 38 and 40, respectively, for tapered channel 36, and identified as 38x and 40x, respectively, for tapered channel 36x.)

Also as will be noted, in the form shown, the transverse wall taper "B" of the tapered channel 36 of the 1st Embodiment having flat walls is 45° on each side.

Also as shown as to the 1st Embodiment, particularly noting FIG. 3, the longitudinal flat walls of the 1st Embodiment are provided to not proceed to a line of intersection, but are smoothly connected by a short radius 60; and it, in the small nozzle head, is of the order of 0.02 inches.

Other than these details of comparison of the 1st Embodiment and the 2nd Embodiment, they are sufficiently similar in nature and operativity that it would seem redundant to specify again the nature of the features and operativity characteristics of the tapered channels 36x.

SUMMARY OF COMPONENTS AND OPERATIONAL DETAILS, AND THEIR ADVANTAGES

The present invention as detailed herein has advantages in both concept and in component parts and features; for in contrast to other equipment known to the inventors, and to the prior art cited herein, the invention provides advantageous features which should be considered, both as to their individual benefit, and to whatever may be considered to be also their synergistic benefit toward the invention as a whole:

a. The components of the overall apparatus, once installed, will likely need but little maintenance or any change, in excess of any with the apparatus prior to the provision of the tapered channels;

b. Advantage is taken of the known prior art as to the atomized spray apparatus, and to the pumping or venturi effect of the flow of paint liquid through the nozzle, as considered explainable as a "Bernoulli effect," a generally accepted theory of hydrodynamics;

c. The Bernoulli Principle is the apparent basis of this invention's advantageous operability in comparison to prior art spraying apparatus, a very similar action of fluid mechanics only a fraction of an inch away from the long-conventional nozzle outlet's spray action and effect; yet no one prior to the present invention has had the creativity to conceive the similar venturi feature, even though it is a phenonomenon of both gases and liquids, both being fluids, and subject to the same laws and principles of fluids as to hydrodynamics;

d. This advantageous invention, in contrast to requiring an addition of material, is provided by a lessening of material, i.e., the provision of a tapered channel, which is a lessening of the material of the prior art sprayer apparatus;

e. The improvements of reduction of particle size may be considered as surprising effects of the features of construction and concept mentioned above, i.e., the nozzle-downstream location of the admixture, and the fully-exposed nature of the tapering channels to the infinity of ambient air in the vicinity;

f. Also perhaps to be considered as a surprising nature of the invention, to be noted, the inventors do not assert a precise scientific explanation of all aspects of "how" the invention works, i.e., "how" the invention achieves a significant reduction of particle size; and perhaps (and probably) the "how" of the operativity involves several factors, i.e., liquid pressure upstream, size of the orifice 22, size of the slit 34, surface tension factors, velocity, space relationship of the features, amount of unevenness tolerated, and edge-nature factors, etc., and even such things as temperature might have a significance, at least in context with other factors.

g. By use of this invention, finer atomization is achieved with lower pressure upstream of the nozzle than with other nozzles known to the inventors, except nozzles having a cross-slot orifice which are more costly to manufacture. Such a cross-slot device is made by U.S. Pat. No. 4,346,849.

h. The present invention also seems particularly advantageous in minimizing or avoiding "overspray", meaning an avoidance of an undue amount of the spray mist in a stream not targeted closely to the desired work object. The disadvantage of unwanted and unused extra paint overspray, as wasted material, environmental pollution, and undue messiness of the work area, are of course obvious disadvantages.

CONCLUSION

It is thus seen that liquid sprayer apparatus, provided and used according to the inventive concepts herein set forth, provides novel concepts of a desirable and usefully advantageous device, yielding advantages which are and provide special and particular advantages when used as herein set forth.

No prior art component or element has ever suggested the modifications of any other prior art to achieve the particulars of the novel concepts or the overall combinations here achieved, with the special advantages which the overall device provides; and this lack of suggestion by any prior art has been in spite of the long world-wide use of various types of paint spraying and other liquid spraying equipment, even that of sophisticated nature which adds a fluid to a moving stream of other fluids.

And particularly is the overall difference from the prior ark significant when the non-obviousness is viewed by a consideration of the subject matter of this overall device as a whole, as combination integrally incorporating features different in their combination from the prior art, in contrast to merely separate details themselves, and further in view of the prior art of other and diverse uses, concepts and devices not achieving particular advantages here achieved by these combinations.

Accordingly, it will thus be seen from the foregoing description of the invention according to these illustrative embodiments, considered with the accompanying drawings, that the present invention provides new and useful concepts of novel and advantageous apparatus, possessing and yielding desired advantages and characteristics in formation and use, and accomplishing the intended objects, including those hereinbefore pointed out and others which are inherent in the invention.

Modifications and variations may be effected without departing from the scope of the novel concepts of the invention; accordingly, the invention is not limited to the specific embodiments, or form or arrangement of parts herein described or shown.

We claim:

1. A nozzle for a high pressure liquid atomizer apparatus which is provided with a source of liquid under pressure, the nozzle having:

(a) a body member having body means for connection to associated support and guidance means of the atomizer apparatus;

(b) the body member having an upstream inlet, a downstream outlet, and a passageway operatively between and operatively communicating the inlet and outlet;

(c) the outlet having a nozzle orifice for discharge of the liquid under pressure;

(d) the body member having a generally cylindrical wall means extending downstream of the nozzle orifice, the downstream wall means providing a protecting shield for the nozzle orifice, and (e) the nozzle orifice having, as its most-downstream dispensing outlet opening, a narrow transverse slit;

(f) the slit being located generally centrally of the said wall means;

(g) the body member's generally cylindrical wall means being provided with an upstream opening having an upstream-most portion at least as far upstream as the location of the nozzle outlet slit, such that, in use, ambient air is communicated to the immediate location of the nozzle outlet slit and the immediate location of the base of the spray stream emitted therefrom;

wherein the improvement comprises the provision of the following features and characteristics:

(H) a tapered channel in the said wall means having a channel axis;

(I) the tapered channel having the following characteristics, in combination with one another and operatively with the recited features of said body member;

(J) the tapered channel extending in a generally radial direction with respect to the said wall means, and generally toward the longitudinal axis of the nozzle and generally centrally of the slit;

(K) the tapered channel extending from an air inlet opening on the exterior of said wall means, fully through the said wall means to an air outlet opening on the interior of said wall means;

(L) the channel axis at the air outlet opening of the tapered channel being operatively adjacent, but spaced downstream from, the nozzle outlet opening slit, for cooperating with, and taking advantage of the hydraulic effect of, the pressurized flow of liquid from the body member outlet slit, and the consequent venturi effect of the lowering of pressure downstream of the slit, in use;

(M) the taper of the tapered channel is of such nature that it is larger at its air inlet opening than at its air outlet opening;

(N) the direction of the tapered channel, from its air inlet opening to its air outlet opening, is in the downstream direction of the flow of liquid through the body member and nozzle outlet orifice;

(O) the provisions of the said tapered channel as to (1) its said radial direction, and generally toward the longitudinal axis of the nozzle and generally centrally of the slit, (2) its said downstream direction, (3) its tapering nature in the downstream direction, and (4) its channel axis at the air outlet being located downstream and operatively adjacent to the body member's outlet nozzle orifice, all cooperating to draw ambient air through the tapered channel and in a direction operatively near the center of particles of the liquid being dispensed by the body member's outlet orifice, causing the ambient air flowing through the tapered channel to intermix with liquid particles being dispensed, and at operatively high enough a velocity, to reduce the droplet size of the liquid particles being dispensed.

2. The nozzle as set forth in claim 1, wherein there are provided a plurality of said tapered channels spaced circumferentially of the longitudinal axis of the body member.

3. The nozzle as set forth in claim 2, wherein the direction of the tapered channels, considered transversely of the longitudinal axis of the body member, is about 90° from the direction of said slit.

4. The nozzle as set forth in claim 3, wherein said upstream opening is provided to be a generally semi-cylindrical recess opening in the downstream direction of liquid flow, substantially parallel to the direction of said slit, and the air outlet opening of each tapered channel is provided to be adjacent the downstream end of the recess.

5. The nozzle as set forth in claim 2, wherein said upstream opening means is provided to be a generally semi-cylindrical recess opening in the downstream direction of liquid flow, substantially parallel to the direction of said slit, and the air outlet opening of each tapered channel is provided to be adjacent the downstream end of the recess.

6. The nozzle as set forth in claim 2, wherein the tapered channels are positioned diametrically of the body member.

7. The nozzle as set forth in claim 1, wherein the direction of the tapered channel, considered transversely of the longitudinal axis of the body member, is about 90° from the direction of said slit.

8. The nozzle as set forth in claim 7, wherein said upstream opening is provided to be a generally semi-cylindrical recess opening in the downstream direction of liquid flow, substantially parallel to the direction of said slit, and the air outlet opening of the tapered channel is provided to be adjacent the downstream end of the recess.

9. The nozzle as set forth in claim 1, wherein said upstream opening is provided to be a generally semi-cylindrical recess opening in the downstream direction of liquid flow, substantially parallel to the direction of said slit, and the air outlet opening of the tapered channel is provided to be adjacent the downstream end of the recess.

10. The nozzle as set forth in claim 1, wherein the outlet opening of the tapered channel is radially spaced from the liquid stream being dispensed by the slit, in use, by about the same distance that the downstream portion of the outlet opening of the tapered channel is downstream of the upstream edge of the slit.

11. The nozzle as set forth in claim 1, wherein the channel axis is provided to have its direction downstream of the flow of liquid through the body member to be about 75° with relation to the longitudinal axis of the flow of liquid in use.

12. The nozzle as set forth in claim 1, wherein the channel axis is provided to have its direction downstream of the flow of liquid through the body member to be about 60° with relation to the longitudinal axis of the flow of liquid, in use.

13. The nozzle as set forth in claim 1, wherein the channel axis is provided to have its direction downstream of the flow of liquid through the body member nozzle to be in the range of about 60° to about 75° with relation to the longitudinal axis of the flow of liquid, in use.

14. The nozzle as set forth in claim 1, wherein the said tapered channel is of a tapered wall shape, and the taper ratio is about 3.7 to 1.

15. The nozzle as set forth in claim 1, wherein the said tapered channel is of a tapered wall shape, in which the walls are flat except that at and adjacent their intersection they are curved so as to be smoothly connected in contrast to a line of intersection.

16. The nozzle as set forth in claim 1, wherein the said tapered channel is of a tapered wall shape, the channel being fully open to ambient air along and throughout its entire length through the wall means.

17. The nozzle as set forth in claim 1, wherein the tapered channel is provided to have an intermediate portion formed as having a generally conical shape whose size decreases in a downstream and radially inwardly direction, the narrowest portion of the generally conical shape being adjacent the outlet opening of the tapered channel.

18. The nozzle as set forth in claim 17, wherein there are provided a plurality of said tapered channels spaced circumferentially of the longitudinal axis of the body member.

19. The nozzle as set forth in claim 17, wherein the channel axis is provided to have its direction downstream of the flow of liquid through the body member to be about 60° with relation to the longitudinal axis of the flow of liquid, in use.

20. The nozzle as set forth in claim 17, wherein the taper ratio is about 6.2 to 1.

21. The nozzle as set forth in claim 1, wherein the taper, from larger size to smaller size, is provided as to the channel both in the direction axially-extending downstream from the nozzle outlet and in the direction transversely-extending radially inwardly toward the longitudinal axis of the nozzle.

* * * * *